US006361208B1

(12) United States Patent
Takenaka et al.

(10) Patent No.: US 6,361,208 B1
(45) Date of Patent: Mar. 26, 2002

(54) MAMMOGRAPHY X-RAY TUBE HAVING AN INTEGRAL HOUSING ASSEMBLY

(75) Inventors: Jeff Takenaka; Scott Coles, both of Salt Lake City; Mark Lange; Karen Quinn, both of Salt Lake City, UT (US); Christopher F. Artig, Summit Park, all of UT (US)

(73) Assignee: Varian Medical Systems, Palo Alto, CA (US)

( * ) Notice: Subject to any disclaimer, the term of this patent is extended or adjusted under 35 U.S.C. 154(b) by 0 days.

(21) Appl. No.: 09/449,411

(22) Filed: Nov. 26, 1999

(51) Int. Cl.[7] ..... H01J 35/10
(52) U.S. Cl. ..... 378/199; 378/201
(58) Field of Search ..... 378/199–202, 378/141

(56) References Cited

U.S. PATENT DOCUMENTS 4,384,360 A * 5/1983 Ketadate et al. ..... 378/199
4,811,375 A 3/1989 Klostermann ..... 378/131
4,841,557 A 6/1989 Haberrecker et al. ..... 378/141
4,928,296 A 5/1990 Kadambi ..... 378/141
5,056,126 A 10/1991 Klostermann et al. ..... 378/127
5,515,413 A 5/1996 Knudsen et al. ..... 378/136
5,703,924 A 12/1997 Hell et al. ..... 378/136
5,802,140 A 9/1998 Virshup et al. ..... 378/136
6,134,299 A 10/2000 Artig ..... 378/121

* cited by examiner

*Primary Examiner*—Craig E. Church
(74) *Attorney, Agent, or Firm*—Workman, Nydegger & Seeley

(57) ABSTRACT

The present invention is directed to a radiographic apparatus that utilizes a single integral housing for providing an evacuated envelope for an anode and cathode assembly. The integral housing provides sufficient radiation blocking and heat transfer characteristics such that an additional external housing is not required. The integral housing is air cooled, and thus does not utilize any coolant. In addition, the integral housing is insulated with a dielectric gel material, which electrically insulates the integral housing and its components, and also limits the amount of noise emitted from the housing during operation.

3 Claims, 1 Drawing Sheet

MAMMOGRAPHY X-RAY TUBE HAVING AN INTEGRAL HOUSING ASSEMBLY

BACKGROUND OF THE INVENTION

1. The Field of the Invention

The present invention relates to x-ray generating devices. More particularly, the present invention relates to an x-ray tube having an integral housing assembly that allows for improved performance, especially in x-ray mammography applications.

2. The Relevant Technology

X-ray devices are extremely valuable tools for use in a variety of medical applications. For example, such equipment is commonly used in areas such as diagnostic and therapeutic radiology; radiography is of particular use to diagnose breast cancers.

Regardless of the particular application involved, the basic operation of medical x-ray devices is similar. In general, x-rays, or x-ray radiation, are produced when electrons are produced and released, accelerated, and then stopped abruptly. Typically, this entire process takes place within a housing that defines an evacuated envelope; the housing is typically constructed of glass, metal, or a combination thereof. Three primary components are typically disposed within the evacuated envelope: a cathode, which produces the electrons; an anode, which is axially spaced apart from the cathode and oriented so as to receive electrons emitted by the cathode; and an electrical connection for allowing a voltage generation element to apply a voltage between the cathode and the anode to accelerate the emitted electrons.

In operation, a voltage potential is applied between the cathode and the anode. This causes the electrons that are emitted from the cathode filament to form a thin stream or beam, and accelerate to a very high velocity towards target surface positioned on the anode. This target surface (sometimes referred to as the focal track) is comprised of a refractory metal, so that when the electrons strike the target surface, at least a portion of the resulting kinetic energy is converted to electromagnetic waves of very high frequency, i.e., x-rays. The resulting x-rays emanate from the anode target surface, and are then collimated for penetration into an object, such as an area of a patient's body. As is well known, the x-rays that pass through the object can be detected and analyzed so as to be used in any one of a number of applications, such as a medical diagnostic examination.

In general, a very small part of the input energy results in the production of x-rays. A majority of the kinetic energy resulting from the electron collisions at the target surface is converted into heat of extremely high temperatures. The heat is absorbed by the anode and is conducted to other portions of the anode assembly, and to the other x-ray tube components that disposed within the evacuated envelope housing. Over time, this heat can damage the anode, the anode assembly, and/or other tube components, and can reduce the operating life of the x-ray tube and/or the performance and operating efficiency of the tube.

Several approaches have been used to help alleviate problems arising from the presence of these high operating temperatures. For example, in some x-ray devices the x-ray target, or focal track, is positioned on an annular portion of a rotatable anode disk. The anode disk (also referred to as the rotary target or the rotary anode) is then mounted on a supporting shaft and rotor assembly, that can then be rotated by some type of motor. During operation of the x-ray tube, the anode disk is rotated at high speeds, which causes the focal track to continuously rotate into and out of the path of the electron beam. In this way, the electron beam is in contact with any given point along the focal track for only short periods of time. This allows the remaining portion of the track to cool during the time that it takes to rotate back into the path of the electron beam, thereby reducing the amount of heat absorbed by the anode.

While the rotating nature of the anode reduces the amount of heat present at the focal spot on the focal track, a large amount of heat is still present within the anode, the anode drive assembly, and other components within the evacuated housing. This heat must be continuously removed to prevent damage to the tube (and any other adjacent electrical components) and to increase the x-ray tube's efficiency and overall service life.

One approach has been to place the housing that forms the evacuated envelope within a second outer metal housing, which is sometimes referred to as a "can." This outer housing or can serves several functions. First, it acts as a radiation shield to prevent radiation leakage. As such, it must be at least partially constructed from some type of dense, x-ray absorbing metal, such as lead. Second, the outer housing serves as a container for a cooling medium, such as a dielectric oil, which is can be continuously circulated by a pump over the outer surface of the inner evacuated housing. As heat is emitted from the x-ray tube components (anode, anode drive assembly, etc.), it is radiated to the outer surface of the evacuated housing, and then at least partially absorbed by the coolant fluid. The heated coolant fluid is then passed to some form of heat exchange device, such as a radiative surface, and the heat is removed. The fluid is then re-circulated by the pump back through the outer housing and the process repeated.

The dielectric oil (or similar fluid) can be used to serve functions other than cooling. For example, the oil serves as an electrical insulator between the inner evacuated housing, which contains the cathode and anode assembly, and the outer housing, which is typically comprised of a conductive metal material.

While useful as a heat removal medium and/or as an electrical insulator, the use of oil and similar liquids can be problematic in several respects. For example, use of a fluid adds complexity to the construction and operation of the x-ray generating device in several areas. First, use of fluid requires that there be a second outer housing or can structure to retain the fluid. This outer housing is constructed of a material that is capable of blocking x-rays, and it must be large enough to be completely disposed about the inner evacuated housing and allow fluid to be disposed therein. This increases the cost and manufacturing complexity of the overall device. Also, the outer housing requires a large amount of physical space, resulting in the need for an overall larger x-ray generating device. Similarly, the space required for the outer housing reduces the amount of space that can be utilized by the inner evacuated housing, which in turn limits the amount of space that can be used by other components within the x-ray tube. For example, the size of the rotating anode is limited; a larger diameter anode is desirable because it is better able to dissipate heat as it rotates.

Moreover, construction of the outer housing adds expense and manufacturing complexity to the overall device in other respects. If the liquid is used as a coolant, the device may also be equipped with a pump and a radiator and the like, that in turn must be interconnected within a closed circulation system via a system of tubes and fluid conduits. Also, since the oil expands when it is heated, the closed system must provide a facility to expand, such as a diaphragm or similar structure. Again, these additional components add complexity and expense to the x-ray device's construction. Moreover, the tube is more subject to fluid leakage and related catastrophic failures attributable to the fluid system.

The presence of a liquid coolant/dielectric is also detrimental because it does not function as an efficient noise insulator. In fact, the presence of a liquid may tend to increase the mechanical vibration and resultant noise that is emitted by the operating x-ray tube. This noise can be distressing to the patient and/or the operator. The presence of liquid also limits the ability to utilize other, more efficient materials for dampening the noises emitted by the x-ray tube due to space restrictions and the need for effective electrical insulation.

Some prior art x-ray tubes have eliminated the use of an outer housing and fluid as a coolant/dielectric medium. For example, some solutions utilize forced air to remove heat from the evacuated housing and its components. However, these approaches have not been entirely satisfactory for a variety of reasons. Also, proposed solutions are not well suited for certain types of x-ray applications, such as x-ray mammography.

For example, known x-ray generating devices that utilize forced air as a cooling medium are adapted for high voltage x-ray applications; such applications typically utilize a 150 kV operating potential, or higher, between the anode and cathode. High operating voltages result in higher operating temperatures, and to ensure sufficient heat removal with air convection, these x-ray tubes typically are equipped with fins, or channels formed on the outer surface of the evacuated envelope so as to enhance heat removal. As with previous solutions, this need for additional structure increases manufacturing complexity, and requires additional physical space requirements for the assembly. Moreover, in these types of devices, since the outer housing is eliminated, the housing forming the evacuated enclosure must provide a sufficient level of radiation shielding. To do so at such higher operating voltage levels, the walls that form the enclosure must either be very thick, or must be constructed of more expensive materials. Again, this requires increased physical space and/or results in higher manufacturing costs.

In addition to the increased shielding capacity that must be provided by the walls of the single housing forming the evacuated enclosure, prior art devices must also provide additional shielding within the enclosure itself. For instance, openings are typically provided through the top and bottom portions of the evacuated housing, for example, to allow for the passage of electronic wires to the cathode assembly. Additional shielding structure must be provided so as to block any x-rays from excaping through these openings. Again, this adds to the amount of physical space that is available to other components, and increases manufacturing complexity of the x-ray tube.

Radiographic devices utilizing air cooling must also replace the dielectric oil as the means for electrically insulating the evacuated envelope (the cathode and the anode) from the rest of the assembly. Also, the device must provide for some facility for reducing the amount of noise emitted by the x-ray tube during operation. As previously noted, the occurrence of noise resulting from a rotating anode can be especially troublesome to patients during some applications, such as mammography applications. However, the use of ceramic insulators and the like that are used in known devices do little to reduce operating noise, and thus have not been entirely satisfactory.

Thus, what is needed in the art, is a radiographic device that does not require the use of an outer housing for containing oils or similar fluids for the removal of heat and/or for providing a electrical insulator. Such a device would thereby eliminate the liabilities associated with the use of such fluids, such as increased manufacturing complexity, potential for failure and need for increased physical space. Moreover, the device should be especially suited for lower energy applications, such as mammography. The device should also preferably maintain safe levels of radiation containment, and should also emit low amounts of audible noise during operation.

OBJECTS AND BRIEF SUMMARY OF THE INVENTION

It is therefore a primary object of the present invention to provide an x-ray generating device that eliminates the need for multiple housings, and instead utilizes a single integral evacuated housing for containing the components of the x-ray tube.

Another objective of the present invention is to provide an integral evacuated housing that is especially suitable for use in connection with low power radiation applications such as mammography.

A related objective of the present invention is to provide an x-ray generating device that is reduced in size, and that utilizes a fewer number of components so as to have reduced manufacturing costs and increased reliability.

Another objective of the present invention is to provide an x-ray generating device that utilizes an integral evacuated housing assembly for enclosing the anode and cathode assembly that provides sufficient levels of radiation shielding and limits the amount of radiation leakage to acceptable levels.

A related objective is to provide an x-ray generating device that utilizes an integral. evacuated housing assembly for enclosing the anode and cathode assembly that acts as a heat transfer element for transferring heat away from the anode and anode assembly.

Yet another objective of the present invention is to provide an x-ray generating device that utilizes an integral evacuated housing assembly that can be air cooled without the need for fins or similar structure to transfer heat from the anode assembly to the air coolant.

Still another objective of the present invention is to provide an x-ray generating device that emits a low operating noise.

These and other objects and features of the present invention will become more fully apparent from the following description and appended claims, or may be learned by the practice of the invention as set forth hereinafter. Briefly summarized, the present invention is directed to an x-ray generating apparatus that is particularly useful for use in low power x-ray applications, such as mammography. The apparatus eliminates the need for an outer housing, and instead utilizes a single integral housing assembly for providing the vacuum enclosure that contains the cathode and anode assemblies. In preferred embodiments, the x-ray generating apparatus of the present invention is particularly adapted for use in low power applications, where the energy potential between the anode and the cathode is approximately 25–30 kV, with an operating current at approximately 80–100 mA. These lower kV levels produce x-rays that have a lower energy spectrum, and the lower energy x-rays are better absorbed by softer breast tissue, resulting in an overall better contrast in the resulting x-ray image.

In preferred embodiments, the single integral housing is formed as a generally cylindrically shaped body. Supported on a cathode mounting structure within the interior of the housing is a cathode having an emission source for emitting electrons. The cathode is supported so as to be positioned opposite from a focal track formed on a rotating anode. The focal track is positioned on the anode so that x-rays are emitted through a window formed through the side of the housing. In addition, the cathode is freely supported on the cathode mounting structure, insofar as it is supported without the use of an oversized radiation shield or disk for blocking x-rays from exiting an opening formed through the housing. The elimination of a need for a cathode blocking disk frees up space within the interior of the housing, and reduces manufacturing complexity.

In a preferred embodiment, at least a portion of the integral housing is formed of low cost material such as copper, or a copper-like material, that possesses thermal conduction characteristics that allow heat to be absorbed from the anode assembly during operation, and then conducted to the outer surface of the integral housing. Also, that portion of the housing that is adjacent to the rotating anode includes walls that are of sufficient thickness so as to block x-rays, so as to comply with applicable FDA requirements. When used in a lower power mammography application, the x-rays are of relatively lower intensity, and thus the wall thickness needed to shield x-rays is relatively low—even with copper. Again, this reduces the overall size of the integral housing, as well as its cost.

Preferred embodiments of the present invention utilize a forced air convection system to remove heat that is transferred to the outer surface of the integral housing, and to remove heat emitted from the stator, or motor assembly that is used to rotate the anode. This eliminates the need for coolant fluids, such as dielectric oil and the like, and therefore eliminates the problems inherent with the use of such fluids. In one embodiment, a fan is used to direct air over the outer surfaces of the integral housing; preferably the air flow is directed with an air flow shell that is disposed about at least a portion of the integral housing. Moreover, the heat transfer characteristics of the integral housing, together with the airflow, provides sufficient heat transfer such that integral housing does not require fins, channels, or other similar means for conducting heat away from the surface. This too reduces manufacturing complexity, and reduces the overall physical size of the evacuated housing.

Presently preferred embodiments of the present invention also include means for insulating the evacuated housing—both in an electrical sense and in an audible noise sense. In one embodiment, a dielectric gel is disposed between the integral housing and points external to the housing. The gel provides two functions: it electrically insulates the high voltage connection to the anode assembly, thereby preventing arching and charge up of the evacuated integral housing (especially the glass portion). Moreover, the gel acts as a damping material and absorbs vibration and noise that originates from the anode rotor assembly. Reduced noise emissions are especially important to maintain the comfort of the patient and to help reduce any anxiety that would otherwise result from high noise emissions.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
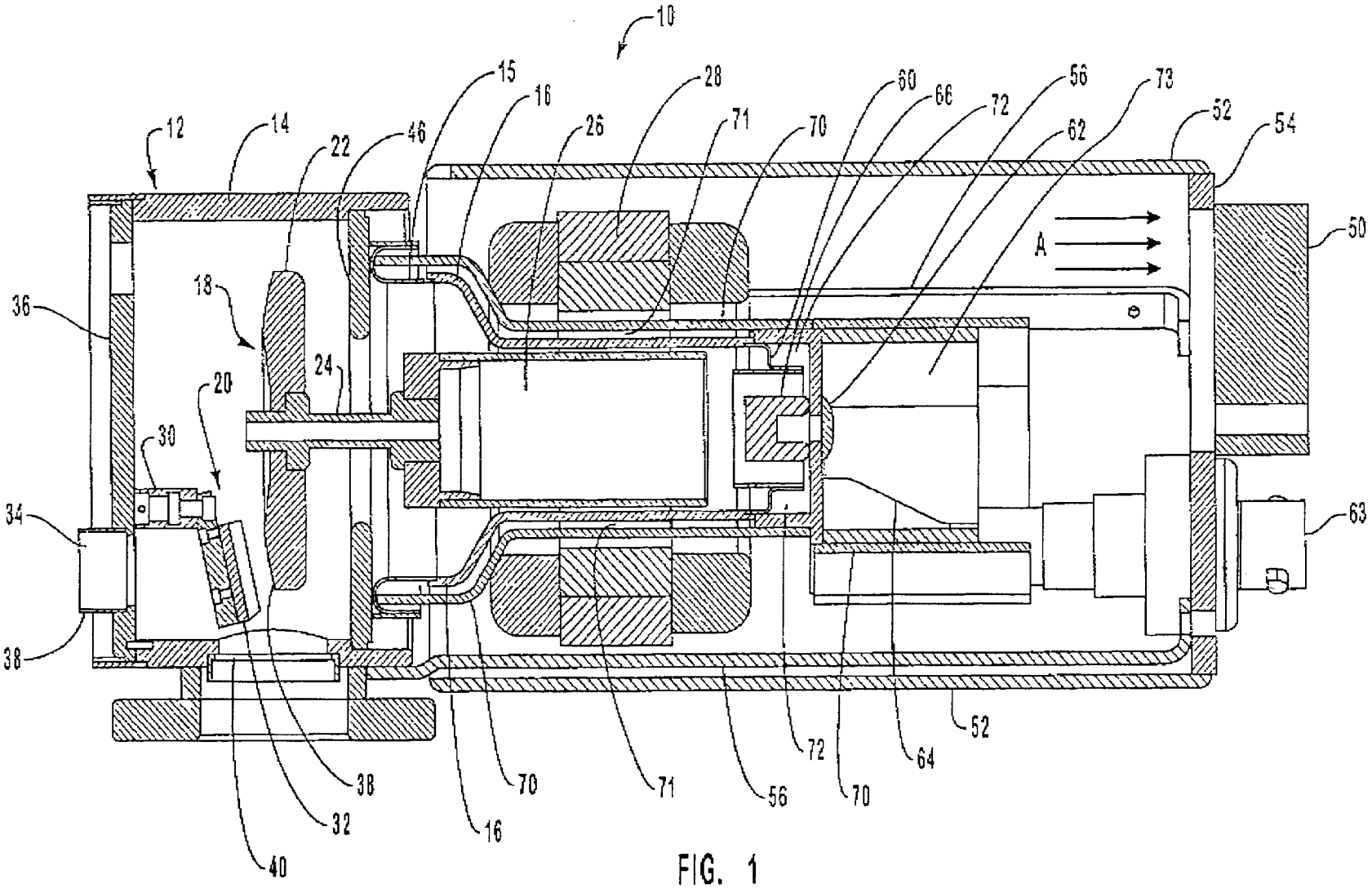
FIG. 1 is a cross-sectional elevational view of one embodiment of an x-ray tube assembly having a single integral housing constructed in accordance with the teachings of the present invention.

Reference will now be made to the drawing, wherein one presently preferred embodiment of the present invention is illustrated. FIG. 1 illustrates a cross-sectional view of an x-ray tube assembly, designated generally at 10, which is constructed with a single integral housing assembly. The single integral housing, designated generally at 12, forms an evacuated enclosure in which is disposed the various x-ray tube components. In the illustrated embodiment, the integral housing 12 is comprised of a first envelope portion 14 and a second envelope portion 16. In this embodiment, the first envelope is comprised of copper, although other materials having a similar density and vacuum characteristics could also be used. The second envelop portion 16 is comprised of glass, or other similar material. A vacuum tight seal is formed between the first and second envelopes, and in one preferred embodiment a kovar ring 15 and a nickel weld is used. Any other appropriate technique could also be used.

Disposed within the integral housing 12 is a rotating anode assembly 18 and a cathode assembly 20. The rotating anode assembly 18 includes a rotating anode target 22, which is connected via a shaft 24 to a rotor 26 for rotation. A stator 28 is disposed outside of the integral housing 12 at a point that is proximate to the rotor 26. The stator 28 is used to rotate the anode 22.

In the illustrated embodiment, the cathode assembly 20 includes a mounting arm 30. The cathode assembly 20 also includes a cathode head 32 and a means for emitting electrons, such as a filament (not shown). The cathode assembly 20 is placed within the vacuum enclosure formed by the integral housing 12. Wires (not shown) for connecting the cathode assembly to an external power source (not shown) pass through the opening 34, which is sealed vacuum tight with a ceramic insulator 38 or the like. In the illustrated embodiment, the cathode head 32 is supported by the mounting arm 30 in a manner that does not require the use of a radiation blocking shield or disk. In large part, such additional structure for blocking x-rays from exiting the ceramic opening is not needed in the illustrated embodiment, which finds particular use in mammography applications. As will be discussed further in such an application the cathode assembly is placed at a very low voltage potential, and the first envelope portion 14 is placed at ground potential. This reduces the need for additional structure for radiation blocking as part of the cathode assembly 20, and thereby frees up space within the vacuum enclosure that can be utilized by other components, as will be further discussed.

A voltage generation means (not shown) is used to create a voltage potential between the cathode assembly and the anode assembly. This causes the electrons that are emitted from the filament of the cathode assembly to accelerate towards and then strike the surface of the anode at a point on the focal track 38, which is comprised of molybdenum (or a similar high Z material). Part of the energy generated as a result of this impact is in the form of x-rays that are then emitted through a x-ray transmissive window 40 that is formed through a side of the integral housing 12 at a point adjacent to the anode 22. As noted, in a presently preferred embodiment, the x-ray tube assembly of FIG. 1 finds particular applicability in mammography applications. During operation in this environment, the anode assembly is maintained at a positive voltage of approximately 25–30 kV and approximately 80–100 mA. This lower kV level produces x-rays that have a lower energy spectrum, which are absorbed by softer breast tissue and thereby produce x-ray images having improved image quality.

In the illustrated embodiment, the first envelope portion 14 of the integral housing 12 serves as a radiation shield. Due to the lower energy x-rays used in the preferred embodiment, this function can be satisfactorily provided by way of the copper material used in the first envelope 14, and can be done so with a relatively small thickness. In the preferred embodiment, satisfactory shielding is obtained with a wall thickness of approximately 0.25 of an inch, which is substantially smaller than that used in prior art devices. A copper material (or its equivalent) of this thickness provides shielding such that radiation leakage does not exceed 20 mRad/Hr at 55 kV and 4 mA at 1 meter distance, when operated at the above power levels.

In the illustrated embodiment, the integral housing 12 further includes an anode plate 46 formed on the side of the anode disk 22 opposite from the cathode assembly 20. The anode plate is also formed of copper, or a copper-like material, and functions as a high voltage shield and as an internal radiation shield.

In addition to providing a radiation blocking function, the integral housing 12 provides yet another function. In particular, the first envelope portion 14 absorbs and thermally conducts heat away from the anode assembly 18, which is generated during operation. Again, the thermal characteristics of copper are ideally suited for this function. Moreover, given the thermal operating characteristics in a mammography applications, heat is transferred to the exterior of the integral housing 12 without the need for fins, channels or other such means for increasing external surface area. Again, this provides a space savings that results in an overall smaller housing, and also reduces manufacturing cost and complexity.

In the illustrated embodiment, heat is removed from the surface of the housing 12 by way of forced air convection. Preferably, air flow over the outer surface of portions of the integral housing 12 is provided by way of a fan mechanism 50. In addition, air flow is controlled via an air flow shell 52 that is disposed about at least a portion of the housing 12. The shell 52 is preferably constructed of a polycarbonate, or similar material, and is oriented so as to control and contain air flow. In the preferred embodiment, the fan 50 is operably connected so as to pull air flow through the shell, as is schematically represented by the arrows at A. Also, in a preferred embodiment, the x-ray tube assembly 10 is oriented at an angle of approximately 4 to 8 degrees, and the fan is positioned more efficiently with respect to hotter air, which migrates to the top interior portion formed by the shell 52. In alternative embodiments, the shell 52 may be provided with a ground plane, and thus will either include at least a portion of electrically conducting material, or may be completely fashioned from a conductive material, such as a thin layer of sheet metal.

In alternative embodiments, the interior surface of the shell 52 can be coated with a sound insulating material, such as various foam materials and the like, to further reduce noise that is emitted by the x-ray tube assembly 10.

With continued reference to FIG. 1, it is shown how in a preferred embodiment, the integral housing 12 is supported by, and affixed to, a support plate 54 by way of a plurality of stator legs, designated at 56. The stator legs are disposed about the outer periphery of the housing 12, with one end being connected to the first envelope portion 14, and the opposite end being affixed to the support plate 54.

FIG. 1 also illustrates how, in the preferred embodiment, the rear end of the housing 12 has disposed therein an anode electrical connector assembly 60. The anode connector 60 provides the means by which the anode is placed at the predetermined voltage potential discussed above. As is shown, the anode connector 60 is connected to an external voltage source (not shown) via a high voltage connector 63 connected through the support plate 54, an electrical wire conduit 64 and a conducting means, such as screw 62. The anode connector 60 is affixed to the rear end of the housing 12 so as to form a vacuum fit therewith in any appropriate manner. In the illustrated embodiment the connection is achieved via kovar ring 66, which is welded to both the glass envelope 16 and the anode connector 60.

Preferred embodiments of the present invention further include a means for electrically insulating the evacuated housing 12. This is achieved in the illustrated embodiment by way of a stator shield 70, that is disposed substantially about the second envelope 16 portion of the housing 12, and which forms reservoirs 71, 72 and 73. Disposed within the reservoirs is a gel material. The gel used is a dielectric, and thus provides a means for electrically insulating the exterior glass surface of the envelope 16 from collecting a potential charge, and also for electrically insulating the electrical conduits 62 and 64 so as to prevent electrical arching. While in the illustrated embodiment the stator shield is illustrated as assuming a particular configuration, it will be appreciated that the shield can be formed as a single integral piece, or a multiple pieces, depending on the particular number and configuration of gel reservoirs that is desired.

Use of the gel material provides yet another important function. As noted, an undesirable effect of the rotating anode drive assembly is mechanical vibration and audible noise. The vibration can be detrimental to the operation of the x-ray tube assembly, and can, together with the audible noise, be very troublesome to the patient being treated. This is reduced by the presence of the gel material, which acts as a buffer between the integral housing 12 and any vibration or noise emitted therefrom. This buffering is improved by virtue of the fact that there is no direct mechanical connection between the housing 12 and the support plat 54; the interface is provided almost exclusively by way of the gel, which serves as a very effective mechanical buffer.

While other gels could be used, in the currently understood preferred embodiment, the gel sold by Dow Corning, and is referred to as Dielectric Gel 3-4154. One objective is to utilize this type of gel so as to limit the noise that is emitted from the tube to less than 50 dBA.

In summary, the above described x-ray tube assembly provides a variety of benefits not previously found in the prior art. A tube assembly utilizing the described integral housing is particularly useful in mammography types of applications. In particular, the integral housing eliminates the need for a second external housing, as well as the need for a fluid coolant cooling system. Effective heat removal is accomplished without the need for external fins or channels for heat transfer on the integral housing. Moreover, the integral housing provides sufficient radiation blocking, nor does it require a separate cathode blocking plate structure internally. All of this is accomplished with a smaller dimensioned outer housing structure. This results in a single x-ray tube integral housing that can be constructed in a smaller space, and that can utilize, for instance, a larger rotating anode disk, which further improves the thermal performance of the x-ray tube. Moreover, the assembly utilizes a unique dielectric gel that provides for both electrical isolation of the integral housing, and also greatly reduces noise that is emitted during operation.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray generating apparatus comprising:

an integral housing forming a vacuum enclosure, at least a portion of the housing being formed of a material capable of providing a predetermined level of radiation shielding;

an anode assembly having a rotating anode with a target portion, the rotating anode being disposed within the vacuum enclosure;

an electron source capable of emitting electrons that strike the target portion to generate x-rays which are released through a window formed through a side of the integral housing;

a shell disposed at least partially about an outer periphery of the integral housing, the shell forming an interior space that directs air flow over at least a portion of the outer surface of the integral housing to remove heat therefrom; and at least one gel containing reservoir disposed along an outer surface of the integral housing.

2. An apparatus as defined in claim 1, wherein the at least one gel containing reservoir is positioned about the integral housing so as to reduce the amount of noise emitted from the housing.

3. An apparatus as defined in claim 1, wherein the at least one gel containing reservoir is positioned about the integral housing so as to electrically insulate the integral housing from an external power source.

* * * * *